United States Patent [19]

Jenkinson

[11] 4,353,547

[45] Oct. 12, 1982

[54] EXERCISING APPARATUS

[76] Inventor: Charles Jenkinson, 150 Farley Ave., Fanwood, N.J. 07023

[21] Appl. No.: 181,021

[22] Filed: Aug. 25, 1980

[51] Int. Cl.[3] ..... A01B 21/00

[52] U.S. Cl. ..... 272/130; 272/134

[58] Field of Search ..... 272/130, 125, DIG. 1, 272/DIG. 5, 134, 129; 128/25 R

[56] References Cited

U.S. PATENT DOCUMENTS

| | | | |
|---|---|---|---|
| 3,420,273 | 1/1969 | Greer | 172/260.5 |
| 3,784,194 | 1/1974 | Perrine | 272/DIG. 1 |
| 3,822,599 | 7/1974 | Brentham | 272/130 X |
| 4,050,310 | 9/1977 | Keiser | 272/130 |
| 4,241,913 | 12/1980 | Zwayer | 272/130 |

FOREIGN PATENT DOCUMENTS

| | | | |
|---|---|---|---|
| 650009 | 2/1951 | United Kingdom | 272/130 |
| 115143 | 5/1969 | United Kingdom | 272/130 |

*Primary Examiner*—Richard J. Johnson
*Attorney, Agent, or Firm*—Robert D. Farkas

[57] ABSTRACT

An exercising apparatus utilizes an inclinable table over which is pivotably secured an arm. The arm is pivotably secured to the free end of a piston whose housing is otherwise pivotably secured to a frame to which the arm is secured. The cylinder has the uppermost chamber filled with oil and coupled to an oil receiving vented chamber by way of two parallel pads, each containing a check valve operable in opposed directions. Each path also contains a manually operable valve, one of which is disposed hydraulically in parallel with a valve containing selectably different size orifices. The lower chamber of the cylinder contains an elastic membrane which segregates the lower chamber into two separate compartments, the upper of which is filled with oil and the lower of which contains air. The operation of the cylinder simulates different weights and the effect of gravity thereon as if a user were actually lifting a barbell.

10 Claims, 3 Drawing Figures

EXERCISING APPARATUS

THE FIELD OF THE INVENTION

This invention relates to apparatuses adapted to simulate barbells in the general class of exercising machines, and more particularly to an apparatus which is utilizable in a reclining or partially inclined position by the exerciser.

DESCRIPTION OF THE PRIOR ART

The prior art abounds with devices suitable for use by an exerciser so as to simulate an exercise of the arm and back and neck muscles of the user. U.S. Pat. No. 232,022, issued to J. H. Gifford et al., on Sept. 7, 1980, teaches a health exercising and gymnastic apparatus in which the user may, in a seated or standing position, pull upon two ropes or cables having at the other end secured dumbbells or other weights. The user, by repeated pulling and releasing motions, effectively lifts the weight from a rest position to a superior position and then permits the weight to resume its starting position. The dumbbells or weights may be of any desired weight and extend over a substantial range of heights. The Gifford apparatus suffers the deficiency of providing an exercising routine somewhat different from that experienced when lifting a conventional barbell and fails to provide an exercising devise simulating a pair of weights connected by a bar, thus failing to teach the user balance as well as stance.

U.S. Pat. No. 2,472,391 issued June 7, 1949 to L. G. Albizu discloses a table attached to a base. A vertically positioned framework is secured to the other end of the base and is useful in supporting a pulley system to which a pair of weights are suspended. The pulleys utilize a pair of rope-like members. One end of the rope-like members support handles, whilst the other end of the rope-like members are detachably secured to the table. In use, the exerciser grasps either end of the ropes and, by manipulating same with various parts of the body, completes a wide routine of exercising operations whilst reclining or sitting on the table. All of the forces restraining the exerciser result from the weight members attached to the rope-like member. Since there are two ropes, each supporting independently weight members, the user does not learn balance or as any mechanism in which the user can adjust the amount of weight save by the addition of more weight members.

U.S. Pat. No. 4,084,815 issued to M. W. Flannery on Apr. 18, 1978 teaches a horizontal first structure and a second structure elevated above the first structure wherein the elevated second structure supports a pulley assembly therefrom, including a journaled pulley. Abutment structure is also provided on the first horizontal space normal from an upstanding plane containing the pulley assembly and against which a person disposed on the first horizontal structure may abut at least a portion of his body to prevent sliding of that person relative to the first horizontal structure toward the aforementioned plane. An elongated flexible tension member has its midportion passed over the journaled pulley and a first end portion of the tension member depends downwardly from the journaled pulley and supports a weight body therefrom. The second end portion of the tension member extends downwardly away from the journaled pulley in a direction inclined away from the aforementioned plane and the lower end of the second portion of the tension member includes structure adapted to be engaged by the free end portion of at least one limb of a person disposed on the first horizontal structure. The weight body may be added to so as to provide a device which permits the person to exert variable forces thereon. However, the apparatus requires the person to leave the first horizontal structure to adjust the amount of weight desired for various exercising routines.

U.S. Pat. No. 3,573,865 issued to W. G. Annas on Apr. 6, 1971 teaches an arcuately moveable pedal upon which the user pushes, the pedal being connected through a mechanism to pivot a weighted beam about a fixed fulcrum. A weight is guided for movement along the beam and is moved by a motor also supported on the beam. The motor and the beam are so mounted that positive or negative force bias can be imposed upon the object engaged by the user. A remote indicating mean shows the position of the weight on the beam. The apparatus is intended to provide a continuous range of simulated weight, depending upon position occupied the weight along the length of the beam. As taught, the Annas device is limited to a mechanism adapted to provide an exercising apparatus useful only by engagement of the user's feet upon a pedal, which pedal in turn is coupled to the beam, so that when pushed, the pedal experiences a resistance related to the location of the weighted member.

SUMMARY OF THE INVENTION

A primary object of the present invention is to provide an exercising apparatus, simulating a barbell, which can be easily adjusted so as to permit the user to experience a wide range of simulated weights attached to the barbell.

Another object of the present invention is to provide an apparatus closely resembling the sensations experienced by a user of an actual barbell, when utilizing the apparatus herein described.

Still another object of the present invention is to provide a barbell-like apparatus suitable for use by men and women, beginners or experts, whilst providing the maximum safety in its use.

Yet another object of the present invention is to provide a mechanical apparatus, simulating a barbell, suitable for use by short or tall users.

A further object of the present invention is to provide an exercising apparatus which the user himself can adjust, while in a horizontal position, to simulate various weighted barbells.

Another object of the present invention is to provide a rigid handle apparatus, which when grasped, may be tilted from the horizontal so as to permit the user to experience the same effect as achieved when a user actually permits the bar of a real barbell to assume a non-horizontal position.

Heretofore, exercising apparatuses adapted to simulate barbells, or actual barbells, when being used in a exercising routine, required the user to adjust the amount of weights employed so as to achieve a desired goal. The user would frequently start with a light load, gradually increasing his load, so as to "tone" his muscles in a definite exercising routine. However, the user was required to stop or interrupt his routine to engage in the necessary step of having weights or adjusting the mechanism, frequently by complicated procedures, so as to effectuate the routine. These unnecessary and complicated steps tend to be cumbersome and time consuming. As a net result, the user frequently eliminates of such steps or, worse, commences to utilize initially an excessively weight, thereby pressing or lifting a weight that is excessive for his otherwise unprepared musculature.

The present invention contemplates this problem and provides a simple yet inexpensive mechanism to avoid physical discomfort and destructive effect of gradually working up towards lifting a great weight. Additionally, the present invention contemplates a solution to artificial barbell which permits the user to experience the same feeling encountered when lifting an actual barbell, as by tilting same, and as by maintaining a barbell in elevated position. The present invention provides an apparatus which is totally safe in use which apparatus is adjustable for individuals of various heights and for use in reclining or semi-inclined positions.

These objects as well as other objects of the present invention will become more readily apparent after reading the following description of the accompanying drawings.

DESCRIPTION OF THE PREFERRED EMBODIMENT

Figure 1:
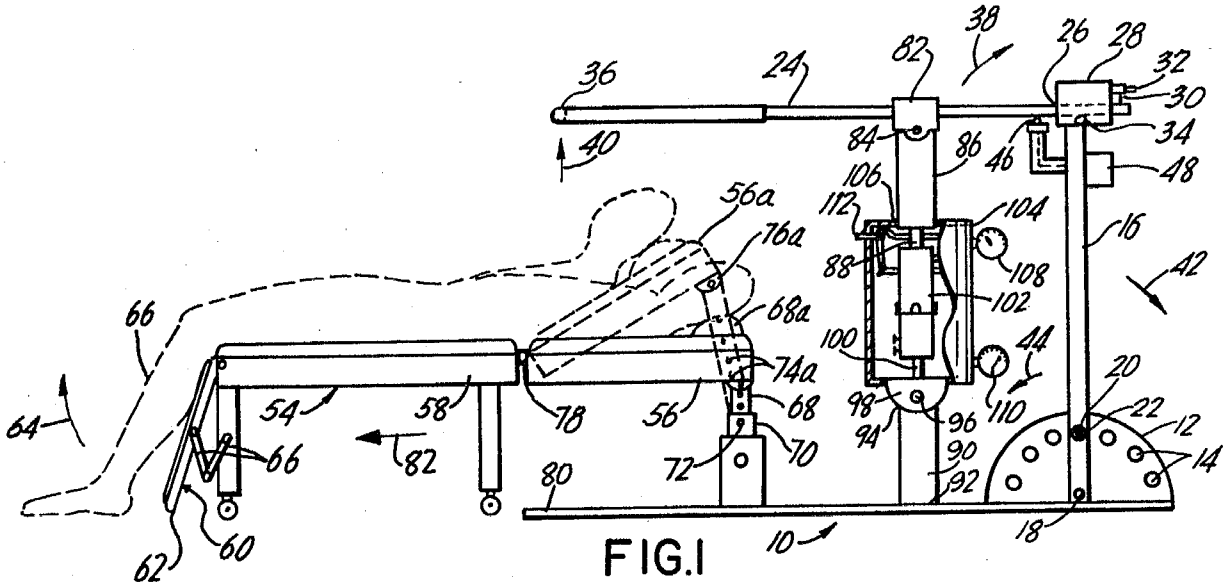
FIG. 1 is a side elevation view of the present invention.
Figure 2:
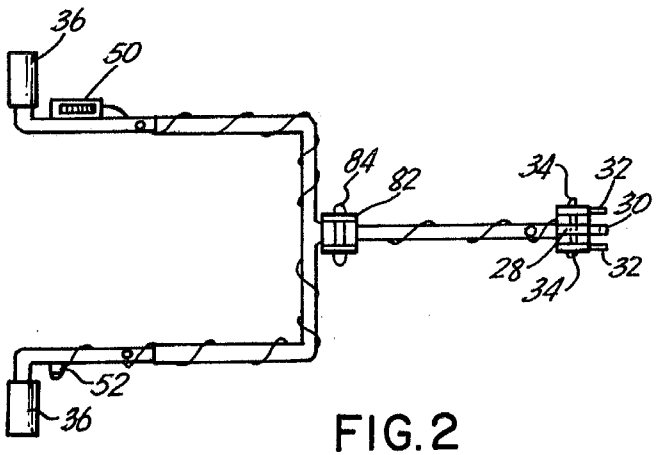
FIG. 2 is a bottom view of the arm of the hand grasping portion of the apparatus shown in FIG. 1.
Figure 3:
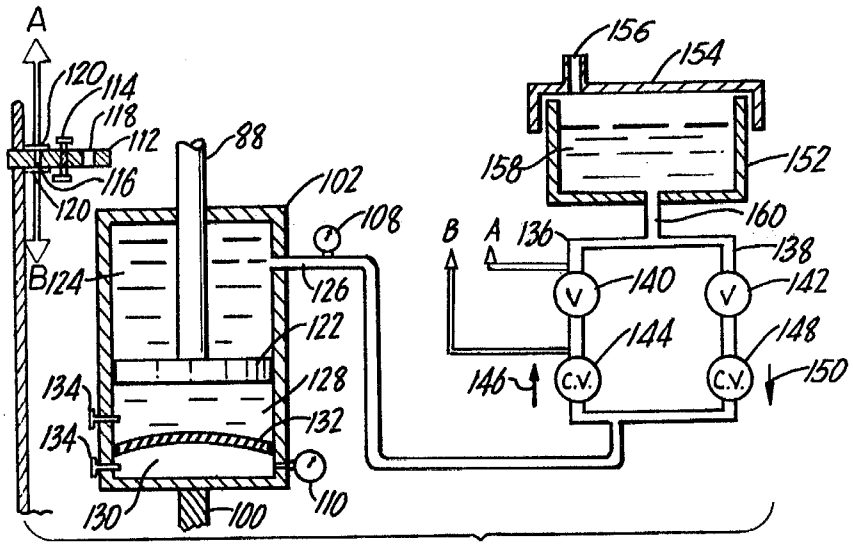
FIG. 3 is a portion of the apparatus of FIG. 1, comprising the hydraulic circuitry of the present invention.

The structure and method of fabrication of the present invention is applicable to an exercising apparatus constituting a platform-like device upon which is secured an elevatable and pivotable supporting bar, such bar is secured to one end of a couch-like structure, otherwise supported upon legs having wheels at the free ends thereof. By elevating the bar-like structure, a portion of the couch may be elevated from the horizontal to an inclined position. The legs of a user, whose back is supported the couch-like structure, may be likewise supported in a horizontal supine position, when a leaf-like sheet is raised from the vertical to a horizontal position, at the distal most end of the couch-like structure. The bed or frame of the apparatus supports a plate in which a plurality of holes, residing in a semi-circular pattern. A post is pivotably secured to the plate and is adapted with a hole, through which a pin may be inserted, engaging one of the semi-circularly disposed holes. Thus, the post may be positioned vertically or skew from the vertical position, at the will of the user. The free end of the post pivotably secures one end of an arm mechanism, utilizing a pin in a clevis-like arrangement. The free end of the arm is fashioned in yoke-like shape, terminating in two coaxially aligned handles. The handles are positioned over the couch-like structure substantially aligned with the shoulders of a user reclining thereon.

A cylinder is positioned in between the base structure and the arm structure, located intermediate the proximal end of the couch-like device and the post. The casing or housing of the cylinder is pivotably secured to the base, again utilizing a clevis-like structure and a supporting rod. The cylinder rod of the piston extends upwardly and couples to the arm, utilizing a clevis-like arrangement and a bore, through which the arm passes, thereby permitting the handle-like ends of the arm to reside in other than a horizontal position. The arm is prevented from assuming a undesired position by two pins disposed in the clevis-like structure which is pivotably secured to the uppermost end of the bar.

The cylinder is provided with one operating port coupled to the chamber at the piston rod end of the cylinder housing. A pipe, coupled to such chamber, diverges into two parallel paths, before terminating in an oil receiving tank. Each path contains a manually adjustable valve, and, a check valve. The check valves are operable in opposite directions. One of the valves is parallel with a hydraulic path including a plate containing therein, a plurality of different sized orifices. The lower chamber of the cylinder contains a flexible membrane, separating a subchamber, disposed adjacent the piston, which subchamber contains a hydraulic fluid. The other subchamber contains air. Both subchambers may be coupled to the atmosphere and coupled to a pumping mechanism so as to permit the apparatus, when being serviced, to contain more or less oil or air, as desired.

The apparatus includes a counter, secured to one arm of the yoke-like end, which counter may be reset upon the activation of a push button, secured to the other arm of the yoke-like portion of the operating arm of the device. The counter is actuated each time the arm is placed in a horizontal position, by communicating with a switch that is mounted to the upper regions of the post.

A pair of pressure gauges are secured to the outermost regions of the housing containing the cylinder so as to permit an observer to determine the amount of pressure experienced in the uppermost chamber of the cylinder and within the air subchamber of the lower chamber of the cylinder.

In use, the user selects a preferred position by adjusting the height of the inclinable shoulder regions of the couch-like structure. This is accomplished by inserting a pin in a preferred hole along the length of the subpost supporting the free end of the inclinable portion of the couch. The couch is free to move towards or away from the base portion of the apparatus depending upon the angle assumed by the inclinable portion of the couch. A conventional scissor-like linkage arrangement is employed when it is desired to elevate the feet of the user from a floor resting position. The user then grasps the hand grasping portions of the arm, resetting the counter to zero. Depending upon the position of the multi-sized orifice plate, various rates of flow will be experienced upon elevating the piston structure of the cylinder, when the user exerts an upward force upon the free end of the operating arm. When the orifice in the multi-sized plate is small, the user will experience greater difficulty in elevating the free end of the operating arm. As the user extends the arm upwardly, hydraulic fluid, preferably of hydraulic oil, leaves the uppermost chamber of the cylinder and passes only through the parallel branch containing the check valve directed towards flow into the oil receiving tank, the other check valve preventing a flow from the uppermost chamber into the tank. The fixed valve, hydraulically coupled to the check valve in use, presets a minimum flow of oil from the uppermost cylinder into the oil receiving tank. More flow can be experienced, depending upon the size of the orifice in use for the path of oil about the fixed valve as above described. Thus, the user can select the rate of speed at which oil may exit the uppermost chamber of the cylinder into the storage tank. As the piston is elevated upwardly, flexible membrane is displaced, causing a partial vacuum to reside within the air subchamber, located at the lowermost end of the cylinder. Thus, there is experienced at all times, a force in a downward direction, directly proportional to the displacement of the cylinder piston. This is accompanied by a resistance experienced by the user, when the user attempts to further elevate the free end of the operating arm. Such resistance may be varied by the simple expedient of rotating the multi-orifice plate. This simulates a weight of a given size, for every position of height accomplished by elevating the free end of the operating arm. If the user elevates the free end of the operating arm rapidly, the user will experience a much heightened resistance thereto, because of the inability of the oil to pass through the fixed valve and selected orifice of the multi-orifice plate. This effect simulates inertia. The ever increasing force experienced by vacuum created in the air subchamber provides a force on the free end of the operating arm proportional to the elevation of such arm. However, the free end of the operating arm cannot descend, with or without assistance from the user, in a free manner, since the other check valve and fixed valve limits the rate of flow of oil from the oil receiving tank back into the uppermost chamber of the cylinder. Thus, the user will continue to experience a downward thrust, by the free end of the operating arm, limited by orifice size of the other fixed valve. Such force is controlled by the amount of vacuum experienced by the air containing subchamber at the time. If desired, another multi-orifice containing plate may be utilized so as to control the rate of flow of hydraulic fluid from the oil receiving tank back into the uppermost chamber of the cylinder. In this condition, the apparatus will then control unlimitedly the amount of force experienced, both in the upward and in a downward direction by a user, when grasping the free end of the operating arm. In an alternate embodiment, a multi-orifice plate may be employed, each containing pairs of holes of dissimilar sizes from all other pairs, one of such pairs being useful in the upstroke of the arm, the other being useful in the downstroke of the arm, thus providing a user with a means of selecting equivalent weights, for upward and downward directions of the free end of the operating arm.

The post may be positioned, as desired, at any angle other than the vertical, by inserting a pin in one of the holes disposed in the semi-circular plate that is secured to the base. This permits the user to begin to flex muscles at different positions other than a position wherein the free end of the operating arm is disposed directly above the shoulder line. If desired, the entire apparatus may be utilized by disengaging the couch-like structure, permitting the user to stand before the base, grasping the arms and operating same as if the user were picking up a barbell from a rack and displacing upwardly and downwardly in convention fashion. In such position, the user stands upon the free end of the base, located directly beneath the free end of the operating arm.

Now referring to the figures, and more particularly to the embodiment illustrated in FIG. 1 showing the present invention base 10 is shown having secured thereto plate 12 containing holes 14, displaced in a semi-circular pattern. Post 16 is shown pivotably secured to plate 12, utilizing pivot rod 18 therefor. Pin 20 is removable from hole 22, located in post 16, and, in the position shown, passes through hole 22 and one of the holes 14, so as to support post 16 in a vertical position. Operating arm 24 is shown having end 26 thereof passing through block 28. Rod 30 is secured adjacent the free end of arm 24, and extends outwardly of block 28. Stop pins 32 extend outwardly from block 28, and are useful in limiting the angular rotation of arm 24. Pin 34 extends through portions of block 28 and through a hole, not shown, in the uppermost end of post 16. Thus, operating arm 24 may be displaced in an angular position wherein hand grasping regions 36 extend upwardly, in the direction of arrow 38, upon exerting an upward force, in the direction of arrow 40, on hand grasping regions 36. Similarly, post 16 may be moved in the direction of arrows 42 or 44, depending upon which hole 14 is utilized for receiving pin 20. Switch contact arm 46 operates a switch, not shown, contained within housing 48. Such switch, via conventional means, operates electically operated counter 50, each time that operating arm 24 has hand grasping region 36, elevated. Momentary push button 52, when depressed, resets counter 50 to a count of zero. Since the counter and push button 52 are positioned adjacent hand grasping regions 36, the user can easily and conveniently count any series of exercising routines.

Couch-like structure 54 is shown having an inclinable portion 56 and a horizontal portion 58. Portion 60, being the leg elevating portion of couch-like structure 54, may be positioned so as to have end 62 thereof displaced upwardly and outwardly, in the direction of arrow 64, by operating linkage arms 66. In the uppermost horizontal position, not shown, for the leg elevating portion of the couch-like structure, the feet of a user, shown by dotted lines 66, may be elevated into a horizontal position. Elevatable portion 56, may be displaced in the position shown by dotted lines 56*a*, when post 68 is elevated upwardly and outwardly from post 70, into the positions shown by dotted lines 68*a*. Pin 72 may be removed from the position shown and reinserted into one of selected holes 74*a*, thereby permitting post 68 to assume a more extended position than in the retracted position shown. Clevis member 76*a* permits the proximal end of couch portion 56 to assume the angle indicated. Hinge 78 permits the mid-region of the couch-like structure 54 to pivot upwardly as shown. Base plate 10 is shown having end 80 thereof extending substantially below hand grasping region 36 of arm 24. When pin 72 is removed from the position shown, couch 54 may be moved in the direction of arrow 82, totally disengaged from base 10. In this condition, the apparatus may be utilized by a user standing directly on end 80 of plate 10.

Block 82 is shown surrounding a mid-region of arm 24. Pin 84 is engaged with rod 86. Rod 86 is secured to the upper end of piston rod 88. Block 82 and pin 84 permit hand grasping region 36, of arm 24, to be extended above the position shown. Rod 90, has end 92 thereof secured to base 10, whilst end 94 contains a hole, not shown, for receiving pin 96 therein. Pin 96 passes through plate 98. Plate 98 is secured to rod 100. Rod 100 is fixedly secured to the exterior of cylinder housing 102. Housing 104 is secured to plate 98. Rod 86 passes through opening 106 in housing 104.

Gauges 108 and 110 are mounted outwardly from housing 104 and may be positioned so that an observer may view same, or, that the individual depicted by dotted lines 66 may view same, as desired. Rotatable plate 112 has a portion thereof shown extending outwardly from housing 104. As can be seen, plate 112 is supported by rod member 114 such that plate 112 may be rotated thereabout, thereby permitting one of a plurality of orifices 116 or 118, or others, not shown, from contacting bearing blocks 120. Such bearing blocks are coupled to lines A and B, such that hydraulic fluid therethrough, must also pass through a selected hole positioned between opposed blocks 120. When plate 112 is rotated, hole 118, shown to be larger than hole 116, may be positioned between blocks 120. Thus, plate 112 and blocks 120 serve as a manually operated valve mechanism having several selectable orifices of different sizes. The size of the hole or orifice disposed in plate 112 and positioned between blocks 120, will determine the rate of hydraulic fluid flow in pipes A and B. Cylinder housing 102 contains piston 122. Uppermost oil containing chamber 124 couples to pipe 126. Pressure gauge 108 is coupled to pipe 126 so as to indicate the amount of hydraulic pressure experienced within uppermost chamber 124. The lowermost regions of the cylinder described by housing 102 contains an uppermost oil receiving chamber 128 and an air containing chamber 130. Flexible rubber-like membrane 132 extends between oil chamber 128 and air containing chamber 130. Gauge 110 couples to air containing chamber 130. Fittings 134 permit more or less oil or air to be coupled into or bled from subchambers 128 and 130 respectively. If desired, air may be pumped into air chamber 130, by a fitting 134. As piston 122 is elevated upwardly, in the direction of arrow 40, flexible membrane 132 is displaced upwardly, causing a partial vacuum or negative pressure, relative to the atmospheric air pressure, to reside within air subchamber 130, located in the lowermost end of piston 122. Thus, there is experienced at all times, a force in a downward direction, directly proportional to the displacement of the cylinder piston on piston rod 88. The ever increasing force experienced by the partial vacuum created in air subchamber 130 provides a force on the free end of operating arm 24 proportional to the elevation of arm 24.

Pipe 126 is split into two parallel paths 136 and 138. Path 136 contains a fixed valve 140. Fixed valve 142 is contained in parallel path 138. Check valve 144 operates only on the flow of oil in the direction of arrow 146 whilst check valve 148 operates only in the flow of oil in the direction of arrow 150. Oil receiving tank 152 is covered by plate 154, having air vent 156 therein. Oil 158 is shown contained within tank 152. Pipe 160 couples the joined uppermost ends of parallel paths 136 and 138 to the interior of oil receiving tank 152. Pipes A and B extend on opposite ends of fixed valve 140, and terminate in blocks 120. If desired, another set of pipes, not shown, may bridge fixed valve 142, terminating in another set of blocks 120, for use with another multi-orifice containing plate 112, or, in a plate containing pairs of holes similar to that to orifices or holes 116 and 118.

Valves 140, 142 and 144 are adjusted manually and located within housing 104. Similarly, check valves 144 and 148 are contained within housing 104, as is oil receiving tank 152. All other portions of the hydraulic circuitry, including cylinder housing 102, are contained within housing 104, excepting for the exposed regions of multi-orifice containing plate 112 and gauges 110 and 108.

Gauge 110 substantially reflects, being a vacuum gauge, the amount of force actually exerted on hand grasping regions 36. Gauge 108, being a hydraulically operated pressure gauge, indicates the instantaneous force being exerted on the hydraulic cylinder by the user when the user attempts to move hand grasping regions 36, at a speed well above the speed permitted by the size of the orifice presented by blocks 120. Thus, the user provided with an apparatus which feels like a barbell of a given weight, and a readout mechanism which permits him or others, to visualize the weight employed, the rate of speed of movement of the weight, and the number of times such imaginary weight is lifted from its rest position.

One of the advantages of the present invention is an exercising apparatus, simulating a barbell, which can be easily adjusted so as to permit the user to experience a wide range of simulated weights attached to the barbell.

Another advantage of the present invention is an apparatus closely resembling the sensations experienced by a user of an actual barbell, when utilizing the apparatus herein described.

Still another advantage of the present invention is a barbell-like apparatus suitable for use by men and women, beginners or experts, whilst providing the maximum safety in its use.

Yet another advantage of the present invention is a mechanical apparatus, simulating a barbell, suitable for use by short or tall users.

A further advantage of the present invention is an exercising apparatus which the user himself can adjust, while in a horizontal position, to simulate various weighted barbells.

Another advantage of the present invention is a rigid handle apparatus, which when grasped, may be tilted from the horizontal so as to permit the user to experience the same effect as achieved when a user actually permits the bar of a real barbell to assume a non-horizontal position.

Thus, there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited, not by the specific disclosure herein, but only by the appending claims.

The embodiment of the invention in which an exclusive privilege or property is claimed are defined as follows:

1. An exercising apparatus comprising an arm, a post, means to pivotably secure one end of said arm to one end of said post, a base, means to secure the other end of said post to said base, a hydraulic cylinder, means to secure one end of said hydraulic cylinder to said base, means to pivotably secure the piston of said hydraulic cylnder to said arm, said hydraulic cylinder having a single port therein, said single port communicating with a first oil containing chamber within said cylinder, a pipe, said pipe communicating with said port, an oil receiving tank, said pipe communicating with said oil receiving tank, a second oil receiving chamber disposed within said cylinder, said first and said second oil receiving chambers hydraulically separated by a slidable piston portion of said cylinder, a rubber-like membrane, said rubber-like membrane disposed within said cylinder, a closed air receiving chamber disposed in said cylinder for containing air therewithin, the interior portions of said air receiving chamber separated from the interior portions of said second oil receiving chamber by said rubber membrane, means to selectively positively pressurize and impose a partial vacuum of said air at a fixed selected air or vacuum pressure within said air receiving chamber only when said slidable piston portion is disposed in a stationary position and at varying decreasing positive pressure levels and increasing partial vacuum in accordance with the position of said slidable piston portion along the length of said cylinder intermediate said stationary position and said pipe, means to independently control the rate of flow of hydraulic fluid from said first oil receiving chamber into said tank and from said tank to said first oil receiving chamber, said means to control including a multi-orifice plate, said multi-orifice plate having a plurality of different size orifices therein, a pair of plate contacting blocks, said pair of blocks selectively engaging one of said orifices, whereby the rate of flow of said hydraulic fluid from said first oil receiving chamber into said tank may be increased when the size of said orifice is increased.

2. The apparatus as claimed in claim 1 wherein said means to selectively control includes a branched hydraulic circuit, said branched hydraulic circuit comprising two parallel hydraulic paths, each of said hydraulic paths including a check valve and a fixed flow valve, wherein the check valves in each said parallel paths are operable in opposite directions.

3. The apparatus as claimed in claim 1 further comprising a couch-like structure, said couch-like structure being removeably secured to said base, one end of said couch-like structure being inclinable, said couch-like structure including legs, the lowermost end of said legs having wheels journaled thereto.

4. The apparatus as claimed in claim 1 further comprising a pair of hydraulically operated gauges.

5. The apparatus as claimed in claim 1 wherein one of said pair of gauges is coupled to said pipe.

6. The apparatus as claimed in claim 1 wherein one of said gauges is coupled to the interior of said air receiving chamber.

7. The apparatus as claimed in claim 1 comprising a counter, a first switch, a second switch, said first switch being secured to said post, said second switch being secured to said arm, said counter being secured to said arm, means to electrically operate said counter when said arm is disengaged from said second switch, means to electrically reset said counter upon the operation of said first switch.

8. The apparatus as claimed in claim 1 wherein said arm is journaled for rotation within said block.

9. The apparatus as claimed in claim 1 further comprising a bar, said bar fixedly secured to said arm, a pair of pins, each of said pair of pins secured to said block, whereby said arm is limited in rotation within said block by said bar engaging one of said pair of pins.

10. The apparatus as claimed in claim 1 wherein said hydraulic fluid comprises an oil.

* * * * *